US009466873B2

(12) United States Patent
Lin

(10) Patent No.: US 9,466,873 B2
(45) Date of Patent: Oct. 11, 2016

(54) ANTENNA STRUCTURE AND WIRELESS COMMUNICATION DEVICE

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 257 days.

(21) Appl. No.: 14/068,251

(22) Filed: Oct. 31, 2013

(65) Prior Publication Data

US 2014/0375522 A1 Dec. 25, 2014

(30) Foreign Application Priority Data

Jun. 20, 2013 (TW) ..... 102121840 A

(51) Int. Cl.
*H01Q 1/24* (2006.01)
*H01Q 9/04* (2006.01)
*H01Q 5/378* (2015.01)

(52) U.S. Cl.
CPC ..... *H01Q 1/243* (2013.01); *H01Q 5/378* (2015.01); *H01Q 9/0421* (2013.01)

(58) Field of Classification Search
CPC ..... H01Q 1/38; H01Q 1/243; H01Q 9/0421
USPC ..... 343/700 MS, 702, 860, 861
See application file for complete search history.

(56) References Cited

U.S. PATENT DOCUMENTS 6,320,545 B1 * 11/2001 Nagumo ..... H01Q 1/22 343/700 MS
2007/0030203 A1 * 2/2007 Tsai ..... H01Q 5/371 343/702
2007/0075902 A1 * 4/2007 Tai ..... H01Q 9/0421 343/700 MS
2010/0079351 A1 * 4/2010 Huang ..... H01Q 1/48 343/846
2010/0141536 A1 * 6/2010 Zhang ..... H01Q 1/243 343/702

* cited by examiner

*Primary Examiner* — Dieu H Duong
(74) *Attorney, Agent, or Firm* — Zhigang Ma

(57) ABSTRACT

An antenna structure includes a feed portion, a ground portion, a first antenna, a second antenna, and a microstrip line. The first antenna includes a first radiating body and a second radiating body. The first radiating body and the second radiating body are both connected to the feed portion. The second antenna is connected to the ground portion and spaced from the second radiating body. The microstrip line is connected between the feed portion and the ground portion to adjust a matching impedance of the antenna structure.

10 Claims, 7 Drawing Sheets

ANTENNA STRUCTURE AND WIRELESS COMMUNICATION DEVICE

BACKGROUND

1. Technical Field

The disclosure generally relates to antenna structures, and particularly to an antenna structure having a wider bandwidth and higher radiating efficiency and a wireless communication device using the antenna structure.

2. Description of Related Art

To communicate in multi-band communication systems, a bandwidth of an antenna of a wireless communication device such as a mobile phone needs to be wide enough to cover multiple frequency bands. Additionally, in a wireless communication device, space available for the antenna is often limited and reduced so that the antenna is susceptible to interference from metal elements of the wireless communication device adjacent to the antenna and has a low radiating efficiency. Therefore, it is a challenge to design an antenna having the wider bandwidth and higher radiating efficiency within a small space.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
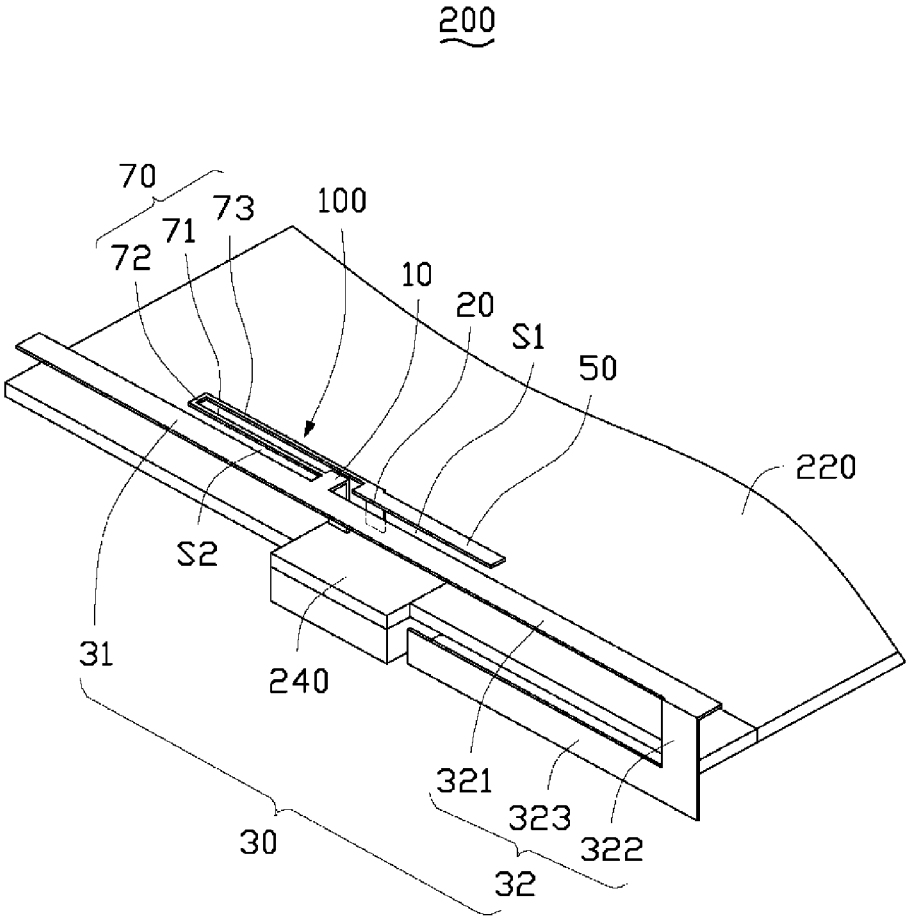
FIG. 1 is a schematic view of a wireless communication device including an antenna structure, according to a first exemplary embodiment.

FIG. 1 is a schematic view of a wireless communication device 200 including an antenna structure 100, according to a first exemplary embodiment of the disclosure. The wireless communication device 200 can be a mobile phone, or a personal digital assistant, for example.

The wireless communication device 200 further includes a circuit board 220 and a metal element 240. The circuit board 220 includes a feed point (not shown) and a ground point (not shown). The feed point is configured to feed current to the antenna structure 100. The ground point is configured to provide ground for the antenna structure 100. In this exemplary embodiment, the metal element 240 is a universal serial bus (USB) interface. The metal element 240 and the antenna structure 100 are positioned at a keep-out-zone of the circuit board 220. The purpose of the keep-out-zone is to prevent other electronic elements (such as a camera, a vibrator, a speaker, etc.) from being placed in a predetermined area where it may interfere with the antenna structure 100.

The antenna structure 100 includes a feed portion 10, a ground portion 20, a first antenna 30, a second antenna 50, and a microstrip line 70.

The feed portion 10 is electronically connected to the feed point of the circuit board 220 by metal wires inside the circuit board 220. In this exemplary embodiment, the feed portion 10 is substantially L-shaped and has one end positioned at a plane perpendicular to a plane of the circuit board 220 and connected to the feed point, and another end positioned at a plane parallel to the plane of the circuit board 220 and connected to the first antenna 30. The ground portion 20 is electronically connected to the ground point of the circuit board 220 by metal wires inside the circuit board 220. In this exemplary embodiment, the ground portion 20 is also positioned at a plane parallel to the plane of the circuit board 220.

The first antenna 30, the second antenna 50, and the microstrip line 70 are positioned at an end of the circuit board 220. The first antenna 30 includes a first radiating body 31 and a second radiating body 32. The first radiating body 31 and the second radiating body 32 are both connected to the feed portion 10 and positioned at opposite sides of the feed portion 10. The first radiating body 31 is a strip-shaped sheet and perpendicularly connected to a side of the feed portion 10 parallel to the circuit board 220.

The second radiating body 32 includes a first radiating section 321, a second radiating section 322, and a third radiating section 323 connected in that order. The first to third radiating sections 321-323 are all strip-shaped sheets. The first radiating section 321 and the first radiating body 31 are coplanar. The first radiating section 321 is perpendicularly connected to another side of the feed portion 10 opposite to the first radiating body 31 and is collinear with the first radiating body 31. The second radiating section 322 and the third radiating section 323 are coplanar and positioned in a plane perpendicular to the first radiating section 321. The second radiating section 322 has one end perpendicularly connected to an end of the first radiating section 321 away from the first radiating body 31 and another end perpendicularly connected to the radiating section 323.

The second antenna 50 is also a strip-shaped sheet. The second antenna 50 and the first radiating body 31 are coplanar. The second antenna 50 is connected to the ground portion 20. The second antenna 50 is parallel to and spaced from the first radiating section 321 so that the second antenna 50 and the first radiating section 321 cooperatively form a first gap S1 between them. In this exemplary embodiment, a width of the first gap S1 is about 1 mm.

The microstrip line 70 and the second antenna 50 are coplanar. A width of the microstrip line 70 is narrower than the widths of the first antenna 30 and the second antenna 50. In this exemplary embodiment, the width of the microstrip line 70 is about 0.3 mm. Two ends of the microstrip line 70 are respectively connected to the feed portion 10 and the ground portion 20. In this exemplary embodiment, the microstrip line 70 is substantially U-shaped and includes a first section 71, a second section 72, and a third section 73. The first to third sections 71-73 are all strip-shaped sheets. The first section 71 is parallel to and spaced from the third section 73. The second section 72 is perpendicularly connected between two ends of the first section 71 and the third section 73 to form the U-shaped structure. Another end of the first section 71 opposite to the second section 72 is perpendicularly connected to the feed portion 10. Another end of the third section 73 opposite to the second section 72 is perpendicularly connected to an end of the ground portion 20 opposite to the second antenna 50. The first section 71 is parallel to and spaced from the first radiating body 31 so that the first section 71 and the first radiating body 31 cooperatively form a second gap S2 between them. In this exemplary embodiment, a width of the second gap S2 is about 1 mm and a length of the first section 71 is less than a length of the first radiating body 31.

When a current is input into the feed portion 10 from the circuit board 220, a portion of the current of the feed portion 10 flows through the first radiating body 31 so that the antenna structure 100 can operate at a first frequency band. Another portion of the current of the feed portion 10 flows through the first radiating section 321. A portion of the current of the first radiating section 321 is coupled to the second antenna 50 and is grounded by the ground portion 20 so that the antenna structure 100 can operate at a second frequency band. Another portion of the current of the first radiating section 321 flows through the second radiating section 322 and the third radiating section 323 so that the antenna structure 100 can operate at a third frequency band. At the same time, the second radiating body 32 activates a fourth frequency band by a frequency-doubled mode. In this exemplary embodiment, the first frequency band has a central frequency of about 1850 megaHertz (MHz), the second frequency band has a central frequency of about 2600 MHz, the third frequency band is about 700-960 MHz, and the fourth frequency band has a central frequency of about 2300 MHz. A portion of the current of the feed portion 10 flows through the microstrip line 70 and is grounded by the ground portion 20 to adjust a matching impedance of the antenna structure 100.

Figure 2:
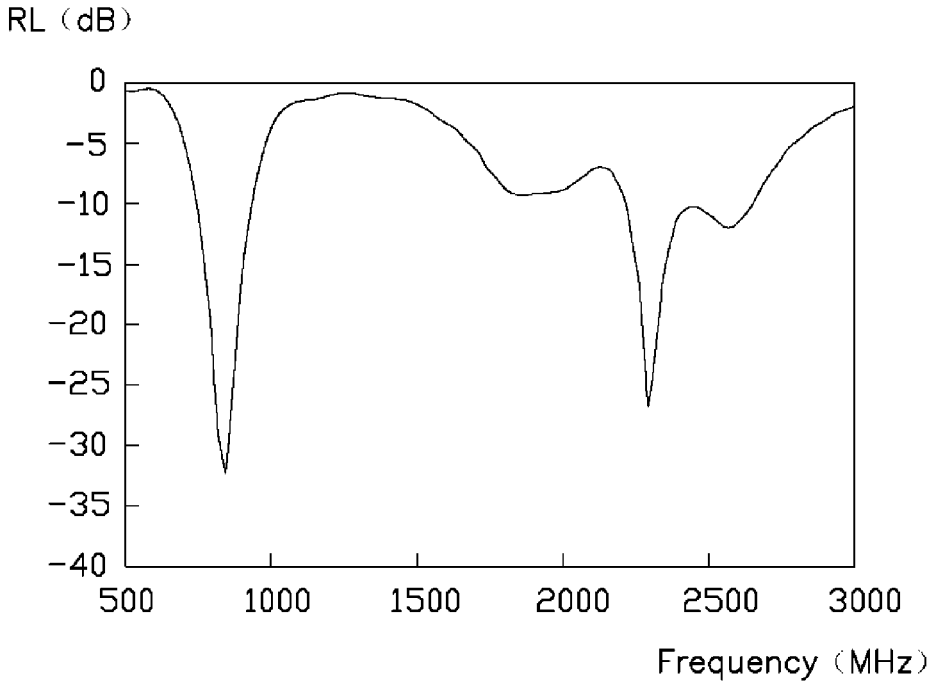
FIG. 2 is a diagram showing return loss measurements of the wireless communication device of FIG. 1.

FIG. 2 shows a return loss graph of the wireless communication device 200. The wireless communication device 200 has a good performance when operating at frequency bands 700-960 MHz and 1710-2690 MHz, and satisfies radiation requirements.

Due to a current from the first antenna 30 being coupled to the second antenna 50, a frequency band of the antenna structure 100 is broadened. In addition, the microstrip line 70 is positioned between the feed portion 10 and the ground portion 20, and the width of the microstrip line 70 is narrower than the widths of the first antenna 30 and the second antenna 50, when the current is fed into the antenna structure 100, the microstrip line 70 has a stronger current distribution. Therefore, the microstrip line 70 can effectively adjust a matching impedance of the antenna structure 100 to reduce interference from the metal element 240 so that the radiating efficiency of the antenna structure 100 is improved, and the antenna structure 100 has a wider bandwidth.

Figure 3:
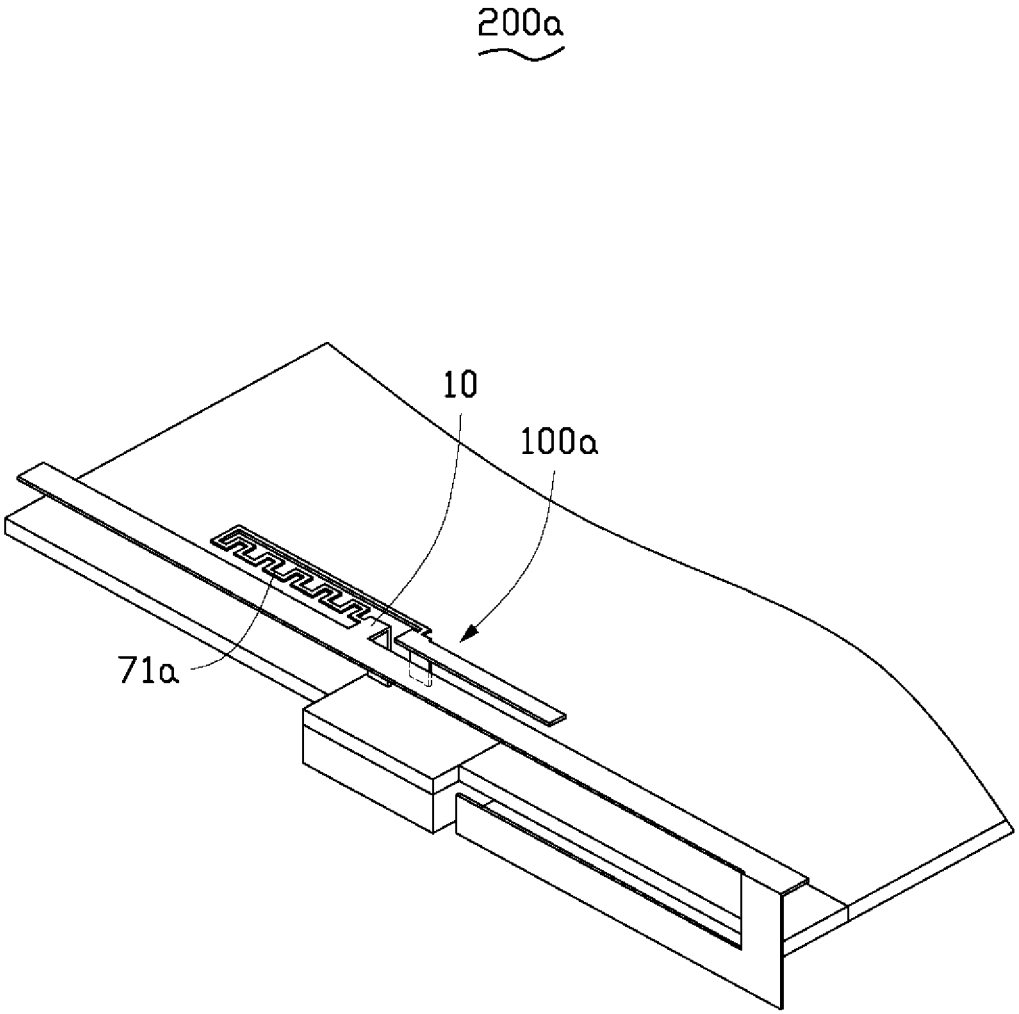
FIG. 3 is a schematic view of a wireless communication device including an antenna structure, according to a second exemplary embodiment.

FIG. 3 shows a wireless communication device 200*a*, according to a second exemplary embodiment, differing from the wireless communication device 200 in that a first section 71*a* is a square wave-shaped sheet and configured to adjust the matching impedance of an antenna structure 100*a*.

Figure 4:
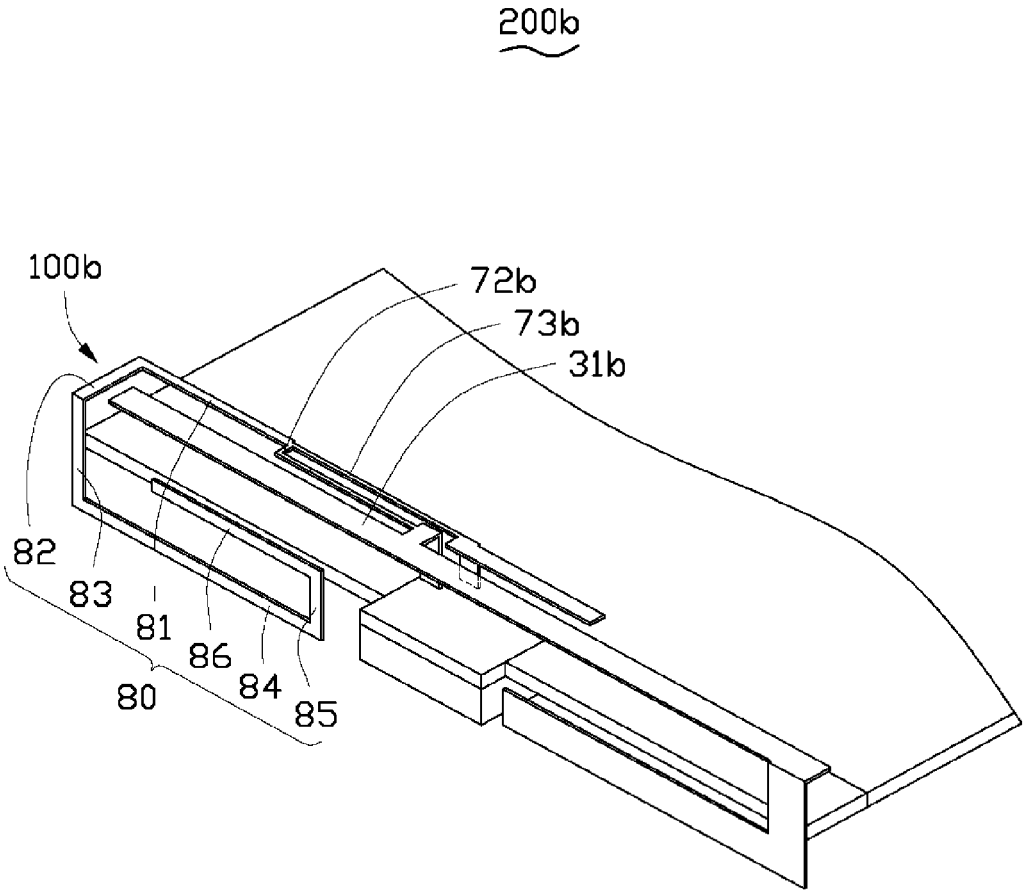
FIG. 4 is a schematic view of a wireless communication device including an antenna structure, according to a third exemplary embodiment.

FIG. 4 shows a wireless communication device 200*b*, according to a third exemplary embodiment, differing from the wireless communication device 200 in that the antenna structure 100*b* further includes an extending portion 80. The extending portion 80 is configured to adjust a bandwidth of the antenna structure 100*b* at a low frequency band and improve a radiating efficiency of the antenna structure 100*b*. The extending portion 80 includes a first extending section 81, a second extending section 82, a third extending section 83, a fourth extending section 84, a fifth extending section 85, and a sixth extending section 86 connected in that order. The first extending section 81, the second extending section 82, and the first radiating body 31*b* are coplanar. The third to sixth extending sections 83-86 are coplanar. An end of the first extending section 81 is extended from a junction of the second section 72*b* and the third section 73*b*. Another end of the first extending section 81 is perpendicularly connected to the second extending section 82 to form a substantially L-shaped structure. The third extending section 83 has one end perpendicularly connected to the second extending section 82 opposite to the first extending section 81, and another end perpendicularly connected to the fourth extending section 84. The fifth extending section 85 is perpendicularly connected to an end of the fourth extending section 84 opposite to the third extending section 83 and parallel to the third extending section 83. The sixth extending section 86 is perpendicularly connected to an end of the fifth extending section 85 opposite to the fourth extending section 84, extends towards the third extending section 83, and is parallel to the fourth extending section 84.

Figure 5:
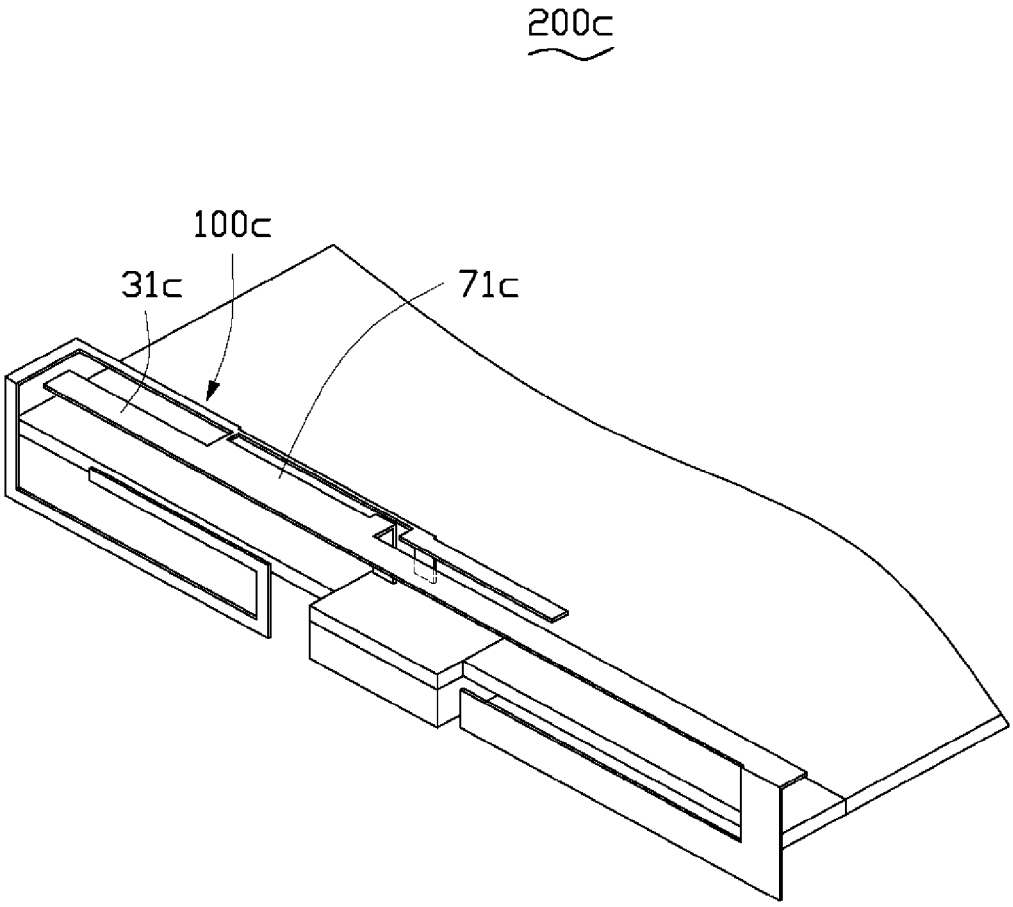
FIG. 5 is a schematic view of a wireless communication device including an antenna structure, according to a fourth exemplary embodiment.

FIG. 5 shows a wireless communication device 200*c*, according to a fourth exemplary embodiment, differing from the wireless communication device 200*b* in that the first section 71*c* is connected to the first radiating body 31*c* and there is no gap formed between the first section 71*c* and the first radiating body 31*c* so that a bandwidth of the antenna structure 100*c* at a low frequency band can be adjusted.

Figure 6:
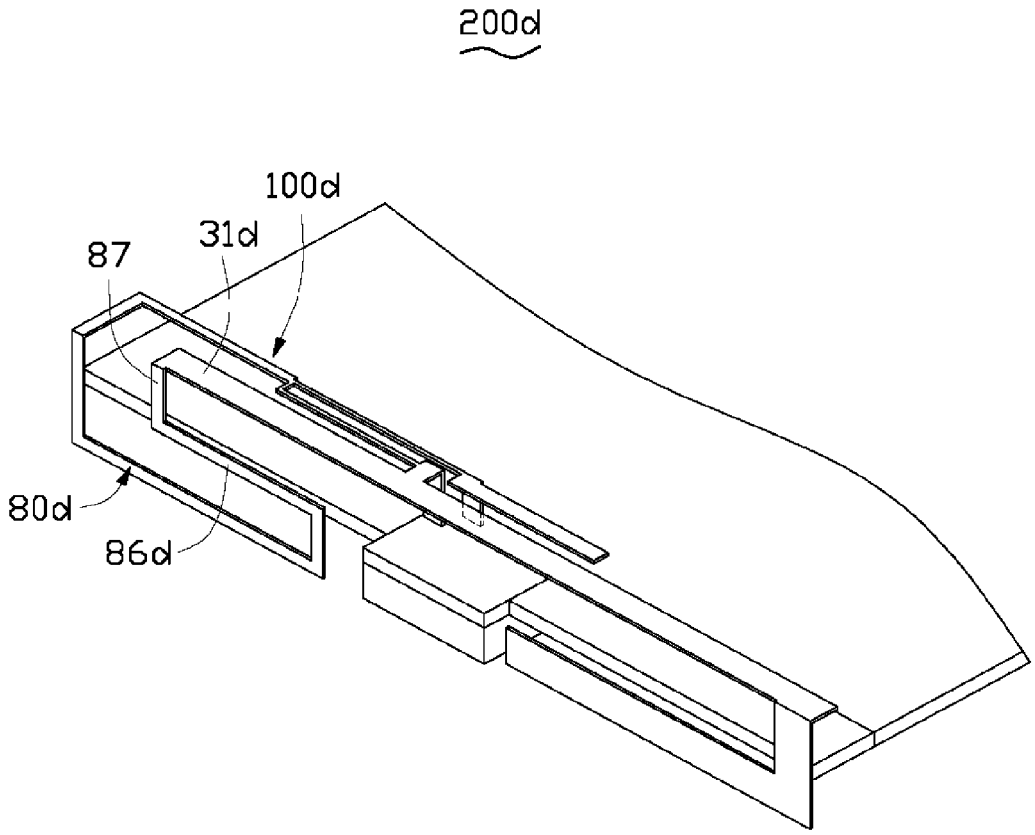
FIG. 6 is a schematic view of a wireless communication device including an antenna structure, according to a fifth exemplary embodiment.

FIG. 6 shows a wireless communication device 200*d*, according to a fifth exemplary embodiment, differing from the wireless communication device 200*b* in that a length of the first radiating body 31*d* is less than a length of the first radiating body 31*b* of the antenna structure 100*b* and the extending portion 80*d* of the antenna structure 100*b* further includes a seventh extending section 87. The seventh extending section 87 and the sixth extending section 86*d* are coplanar. The seventh extending section 87 is perpendicularly connected between two ends of the sixth extending section 86*d* and the first radiating body 31*d* to change a current path of the antenna structure 100*d* and adjust a matching impedance of the antenna structure 100*d*.

Figure 7:
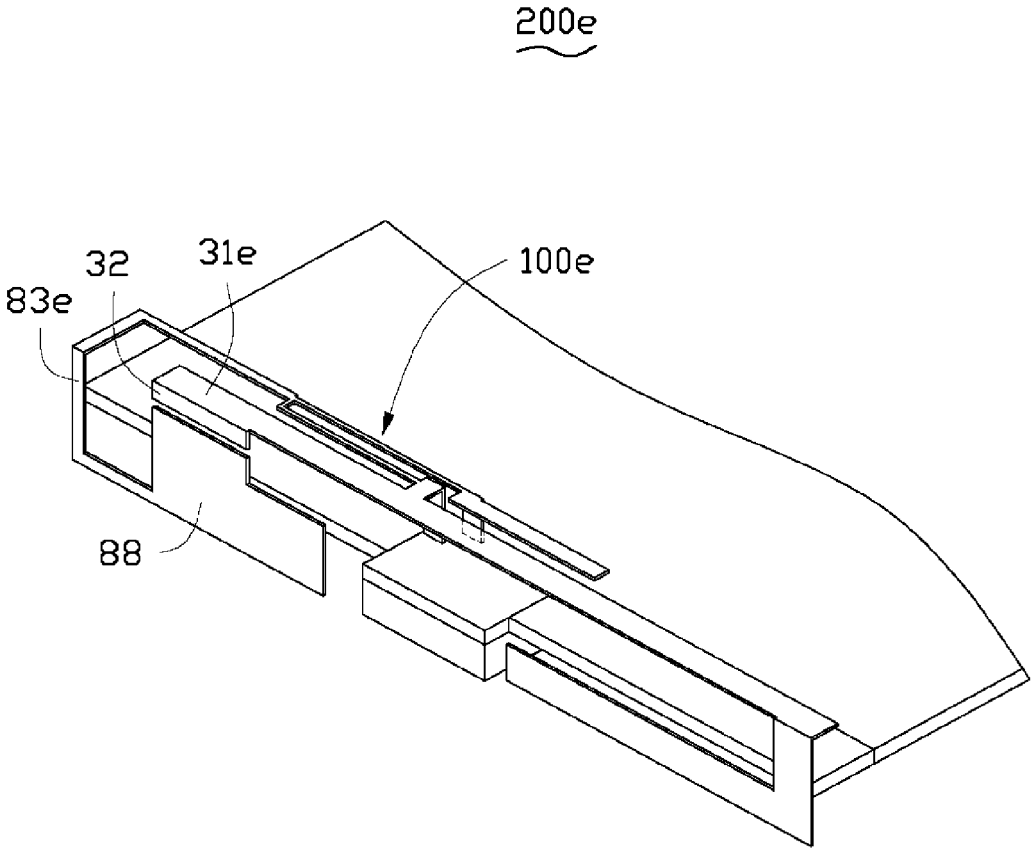
FIG. 7 is a schematic view of a wireless communication device including an antenna structure, according to a sixth exemplary embodiment.

FIG. 7 shows a wireless communication device 200*e*, according to a sixth exemplary embodiment, differing from the wireless communication device 200*b* in that a length of the first radiating body 31*e* is less than a length of the first radiating body 31*b* of the antenna structure 100*b*, the fourth to sixth extending sections 84-86 are replaced by a connecting section 88, and an extending strip 32 extending from one side of the first radiating body 31*e*. The extending strip 32 and the connecting section 88 are coplanar. The connecting section 88 is connected to the third extending section 83*e* and spaced from the extending strip 32.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna structure, comprising:

a feed portion;

a ground portion;

a first antenna comprising a first radiating body and a second radiating body, the first radiating body and the second radiating body both connected to the feed portion;

a second antenna connected to the ground portion and spaced from the second radiating body;

a microstrip line connected between the feed portion and the ground portion to adjust a matching impedance of the antenna structure, the microstrip line comprising a first section, a second section, and a third section; and an extending portion connected to the microstrip line to adjust a bandwidth of the antenna structure at a low frequency band and improve a radiating efficiency of the antenna structure; wherein the extending portion comprises a first extending section, a second extending section, a third extending section, and a connecting section; an extending strip extends from one side of the first radiating body; an end of the first extending section is extended from a junction of the second section and the third section, another end of the first extending section is perpendicularly connected to the second extending section, the third extending section is connected between the second extending section and the connecting section; the connecting section and the extending strip are coplanar and spaced from each other;

wherein the second radiating body comprises a first radiating section, a second radiating section, and a third radiating section connected in that order; the first radiating section is connected to the feed portion; the first radiating body, the first radiating section, the second antenna, and the microstrip line are coplanar, the second radiating section and the third radiating section are coplanar and positioned in a plane perpendicular to the first radiating section.

2. The antenna structure of claim 1, wherein the second radiating section is perpendicularly connected between two ends of the first radiating section and the third radiating section.

3. The antenna structure of claim 2, wherein the second antenna is parallel to and spaced from the first radiating section, the second antenna and the first radiating section cooperatively form a first gap between the first radiating section and the second antenna.

4. The antenna structure of claim 1, wherein one end of the first section is connected to the feed end; the second section is perpendicularly connected between an end of the first section away from the feed portion and an end of the third section, another end of the third section opposite to the second section is perpendicularly connected to the ground portion.

5. The antenna structure of claim 4, wherein the first section is strip-shaped, the first section is parallel to and spaced from the first radiating body, the first section and the first radiating body cooperatively form a second gap between the first section and the first radiating body.

6. The antenna structure of claim 4, wherein the first section is a square wave-shaped sheet and configured to adjust the matching impedance of the antenna structure.

7. A wireless communication device, comprising:

a circuit board; and an antenna structure positioned on the circuit board; the antenna structure comprising:

a feed portion;

a ground portion;

a first antenna comprising a first radiating body and a second radiating body, the first radiating body and the second radiating body both connected to the feed portion;

a second antenna connected to the ground portion and spaced from the second radiating body;

a microstrip line connected between the feed portion and the ground portion to adjust a matching impedance of the antenna structure, the microstrip line comprising a first section, a second section, and a third section; and an extending portion connected to the microstrip line to adjust a bandwidth of the antenna structure at a low frequency band and improve a radiating efficiency of the antenna structure; wherein the extending portion comprises a first extending section, a second extending section, a third extending section, and a connecting section; an extending strip extends from one side of the first radiating body; an end of the first extending section is extended from a junction of the second section and the third section, another end of the first extending section is perpendicularly connected to the second extending section, the third extending section is connected between the second extending section and the connecting section; the connecting section and the extending strip are coplanar and spaced from each other;

wherein the second radiating body comprises a first radiating section, a second radiating section, and a third radiating section connected in that order; the first radiating section is connected to the feed portion; the first radiating body, the first radiating section, the second antenna, and the microstrip line are coplanar, the second radiating section and the third radiating section are coplanar and positioned in a plane perpendicular to the first radiating section.

8. The wireless communication device of claim 7, wherein a width of the microstrip line is narrower than those of the first antenna and the second antenna.

9. The wireless communication device of claim 7, wherein one end of the first section is connected to the feed end; the second section is perpendicularly connected between an end of the first section away from the feed portion and an end of the third section, another end of the third section opposite to the second section is perpendicularly connected to the ground portion.

10. An antenna structure, comprising:

a feed portion;

a ground portion;

a first antenna comprising a first radiating body and a second radiating body, the first radiating body and the second radiating body both connected to the feed portion;

a second antenna connected to the ground portion and spaced from the second radiating body; and a microstrip line connected between the feed portion and the ground portion to adjust a matching impedance of the antenna structure, and an extending portion;

wherein the extending portion comprises a first extending section, a second extending section, a third extending section, a fourth extending section, a fifth extending section, and a sixth extending section, an end of the first extending section is extended from the microstrip line, another end of the first extending section is perpendicularly connected to the second extending section, the third extending section has one end perpendicularly connected to the second extending section opposite to the first extending section, and another end perpendicularly connected to the fourth extending section, the fifth extending section is perpendicularly connected to an end of the fourth extending section and parallel to the third extending section, the sixth extending section is perpendicularly connected to an end of the fifth extending section opposite to the fourth extending section, extends towards the third extending section, and is parallel to the fourth extending section.

* * * * *